US009506688B2

(12) United States Patent
Aygun et al.

(10) Patent No.: US 9,506,688 B2
(45) Date of Patent: Nov. 29, 2016

(54) REFRIGERATOR COMPRISING WATER DISPENSER

(71) Applicant: Arcelik Anonim Sirketi, Istanbul (TR)

(72) Inventors: Oktay Aygun, Istanbul (TR); Ahmet Onur Moza, Istanbul (TR); Arda Ozsu, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days.

(21) Appl. No.: 14/433,819

(22) PCT Filed: Sep. 24, 2013

(86) PCT No.: PCT/EP2013/069822
§ 371 (c)(1),
(2) Date: Apr. 6, 2015

(87) PCT Pub. No.: WO2014/053359
PCT Pub. Date: Apr. 10, 2014

(65) Prior Publication Data

US 2015/0253063 A1 Sep. 10, 2015

(30) Foreign Application Priority Data

Oct. 5, 2012 (TR) ..... A2012 11427

(51) Int. Cl.

| | |
|---|---|
| ***F25D 3/00*** | (2006.01) |
| ***F25D 23/02*** | (2006.01) |
| ***F25D 23/12*** | (2006.01) |
| ***B67D 1/00*** | (2006.01) |

(52) U.S. Cl.
CPC ..... *F25D 23/126* (2013.01); *B67D 1/0009* (2013.01); *F25D 2323/122* (2013.01)

(58) Field of Classification Search
CPC ..... F25D 23/126; F25D 2323/122; F25D 25/025; B67D 2210/00036; B67D 3/009
See application file for complete search history.

(56) References Cited

U.S. PATENT DOCUMENTS

| | | | | |
|---|---|---|---|---|
| 2006/0179851 | A1 | 8/2006 | Himori | |
| 2007/0295023 | A1* | 12/2007 | Yoon | F25D 23/126 62/338 |
| 2010/0251747 | A1* | 10/2010 | Lee | F25C 1/04 62/347 |
| 2012/0060540 | A1 | 3/2012 | Yang et al. | |

FOREIGN PATENT DOCUMENTS

| | | | |
|---|---|---|---|
| GB | 2282216 | A | 3/1995 |
| WO | 2010/133509 | A2 | 11/2010 |

OTHER PUBLICATIONS

International Search Report of WO2014/053359 ( and references cited therein).

* cited by examiner

*Primary Examiner* — Cassey D Bauer
(74) *Attorney, Agent, or Firm* — Kilpatrick Townsend & Stockton LLP

(57) ABSTRACT

The present invention relates to a refrigerator (1) comprising a body (2), at least one door (3) situated on the body (2), a water dispenser (4) situated on the door (3) and enabling the user to receive water without opening the door (3), a storage tank (5) situated on the inner wall of the door (3), a cover (6) situated on the storage tank (5) and having a closed position wherein the cover (6) almost completely covers the top of the storage tank (5) and an open position wherein the cover (6) at least partially opens the top of the storage tank (5), a locking mechanism (7) that enables the cover (6) to be fixed to the storage tank (5) when the cover (6) is in the closed position and a recess (8) arranged on the inner wall of the door (3), behind the storage tank (5).

9 Claims, 4 Drawing Sheets

REFRIGERATOR COMPRISING WATER DISPENSER

Figure 1:
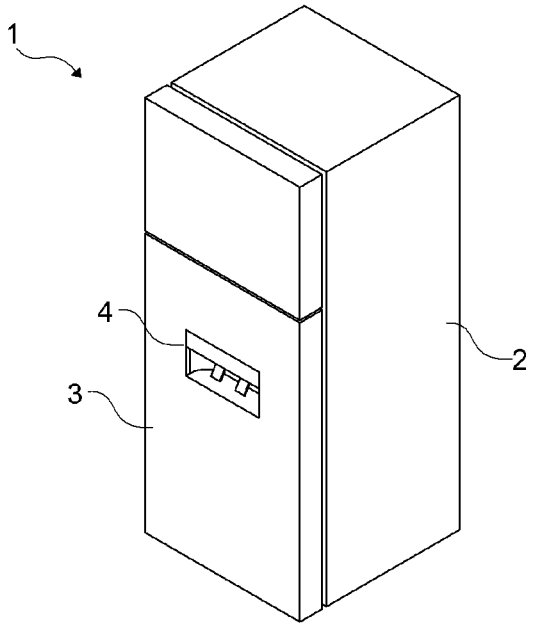

The present invention relates to a refrigerator having water dispenser.

In refrigerators, water dispensers are disposed, that enable the user to receive water without opening the refrigerator door. The said water dispensers comprise a storage tank wherein the water is stored and a recess situated on the inner wall of the door and in front of which the storage tank is disposed. In the state of the art, the refrigerator comprises a hanger situated on the inner wall of the door and providing the storage tank to be hung onto the door. The storage tank is fastened to the door by being hung over the hanger. However, problems are encountered with the storage tank fastened over the hanger remaining in a rigid manner on the door. Especially when the user receives water from the water dispenser, the storage tank moves and displaces.

The hanger is mounted onto the inner wall of the door by screwing. In order for the screw to be inserted into the inner wall of the door, a hole is bored on the inner wall of the door. For this reason, the inner wall of the door is deformed. Moreover, boring the holes in wrong points causes materials to become junk.

In the Japanese Patent Document No. JP3168575, a water dispenser is disclosed, having at least two protrusions situated oppositely on the inner wall of the door and at least two housings situated on the tank and wherein the protrusions are seated. With the protrusions being seated into the housings, the tank is mounted onto the door.

The aim of the present invention is the realization of a refrigerator wherein the water dispenser is mounted without using any screws.

The refrigerator realized in order to attain the aim of the present invention, explicated in the first claim and the respective claims thereof comprises a body, at least one door situated on the body, a water dispenser situated on the door and enabling the user to receive water without opening the door, a storage tank situated on the inner wall of the door, a cover placed onto the storage tank and having a closed position wherein the cover almost completely covers the top of the storage tank and an open position wherein the cover at least partially opens the top of the storage tank, a locking mechanism enabling the cover to be fixed to the storage tank when the cover is in the closed position, and a recess situated on the inner wall of the door, behind the storage tank.

The refrigerator of the present invention comprises at least one protrusion situated on the door and preventing the cover and the storage tank from detaching from the door by snap fitting into the recess while the cover is being mounted onto the storage tank. While the cover is being mounted onto the storage tank, the protrusion enters into the recess. The cover is brought from the open position to the closed position by being rotated. The cover is parallel to the storage tank in the closed position. While the cover is fixed to the storage tank by means of the locking mechanism, the protrusion is snap fitted into the recess. Thus, the cover and the storage tank are provided to be fixed to the door.

In an embodiment of the present invention, the protrusion extends in the horizontal direction from over the cover towards the door. While the cover is in the closed position, the protrusion extends in the horizontal direction inside the recess. The protrusion almost completely touches the inner wall of the door. Friction occurs between the protrusion and the inner wall of the door. Thus, the protrusion snap fitted into the recess is prevented from being easily detached from the recess.

In an embodiment of the present invention, the length of the protrusion is almost equal to the depth of the recess. As the area of the surface where the protrusion contacts the door and the storage tank increases, the friction force increases as well. Thus, it is not possible for the storage tank to slide over the door.

In an embodiment of the present invention, the length of the protrusion is smaller than the depth of the recess. Thus, the protrusion is prevented from remaining outside the recess.

In an embodiment of the present invention, the protrusion is produced integrated with the cover. Thus, saving in assembly cost and time is provided.

In an embodiment of the present invention, the protrusion is shaped as a plate. The protrusion extends in the horizontal direction inside the recess. By means of its shape, the protrusion enters into the space between the inner wall of the door and the storage tank.

In an embodiment of the present invention, the refrigerator comprises the door, of which the part at least partially covering the upper surface of the protrusion is in fillet form.

By means of the present invention, a refrigerator is realized, comprising the water dispenser having a protrusion that enables the storage tank wherein water is stored to be firmly fixed to the inner wall of the door. By means of the protrusion, the storage tank is easily fixed to the door. Thus, saving in assembly cost and time is provided.

A refrigerator realized in order to attain the aim of the present invention is illustrated in the attached figures, where:

FIG. 1—is the perspective view of a refrigerator.

Figure 2:
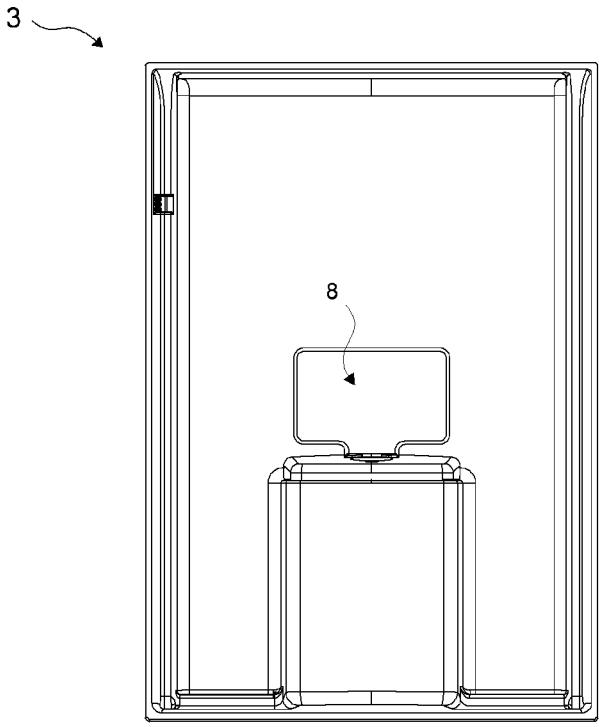

FIG. 2—is the inner view of the door before the storage tank is mounted.

Figure 3:
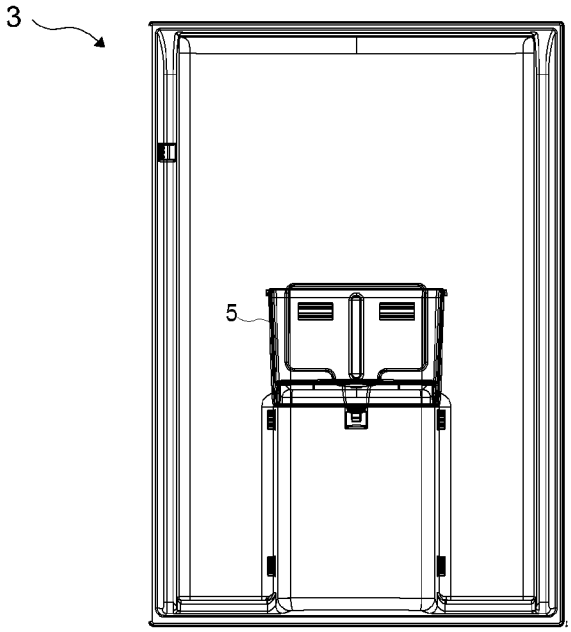

FIG. 3—is the inner view of the door after the storage tank is mounted.

Figure 4:
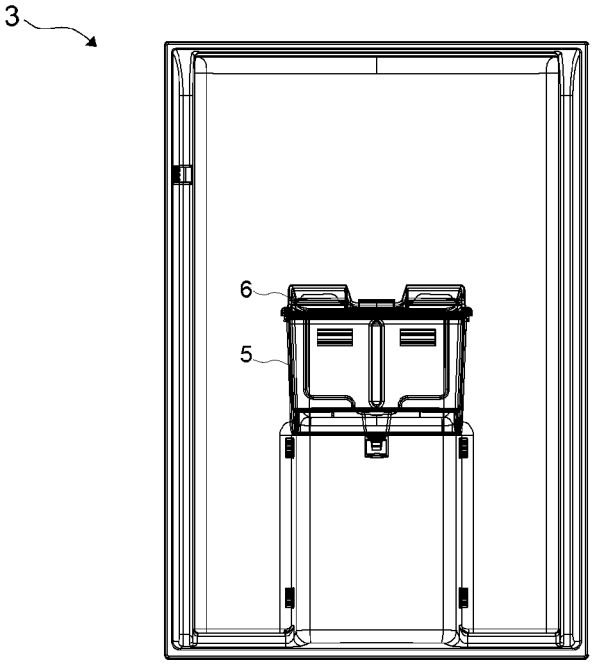

FIG. 4—is the schematic view of the door after the storage tank and the cover are mounted.

Figure 5:
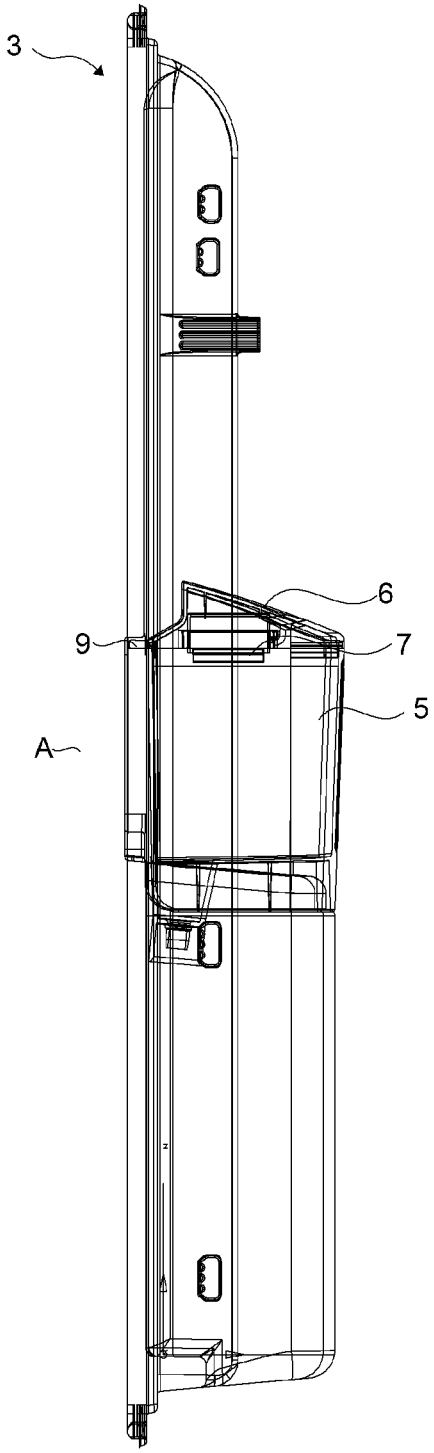

FIG. 5—is the sideways view of the door.

Figure 6:
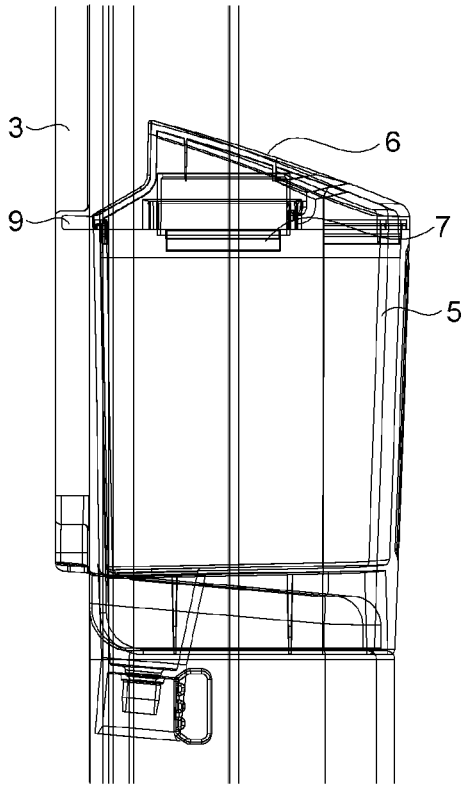

FIG. 6—is the view of detail A in FIG. 5.

Figure 7:
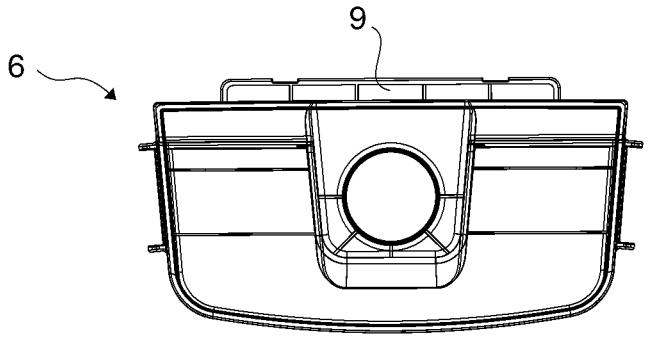

FIG. 7—is the top view of the cover.

Figure 8:
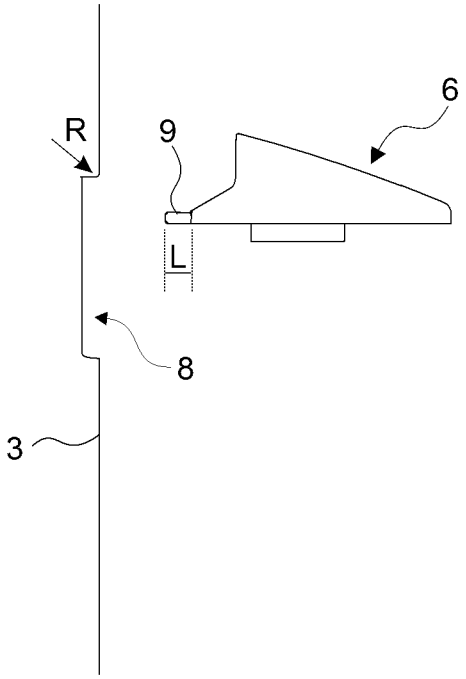

FIG. 8—is the partial exploded view of the cover and the door.

The elements illustrated in the figures are numbered as follows:

1. Refrigerator
2. Body
3. Door
4. Water dispenser
5. Storage tank
6. Cover
7. Locking mechanism
8. Recess
9. Protrusion The refrigerator (1) comprises a body (2), at least one door (3) situated on the body (2), a water dispenser (4) situated on the door (3) and enabling the user to receive water without opening the door (3), a storage tank (5) placed over the water dispenser (4) and onto the inner wall of the door (3), a cover (6) situated on the storage tank (5) and having a closed position wherein the cover (6) almost completely covers the top of the storage tank (5) and an open position wherein the cover (6) at least partially opens the top of the storage tank (5), at least one locking mechanism (7) that enables the cover (6) to be fixed to the storage tank (5) when the cover (6) is in the closed position and at least one recess (8) arranged on the inner wall of the door (3), behind the storage tank (5) (FIG. 1, FIG. 2, FIG. 3).

The refrigerator (1) of the present invention comprises a protrusion (9) that is situated on the cover (6), that is seated into the recess (8) while the cover (6) is being mounted onto the storage tank (5) and that provides the storage tank (5) to be fixed to the door (3) by snap fitting into the recess (8) while the cover (6) is being fixed to the storage tank (5) by means of the locking mechanism (7). The storage tank (5) that enables water to be stored therein is placed in front of the recess (8). While the cover (6) is being placed onto the storage tank (5), the protrusion (9) enters into the recess (8). While the cover (6) passes from the open position to the closed position, the protrusion (9) is squeezed between the cover (6) and the upper wall of the recess (8). During the grouping of the cover (6) with the storage tank (5) by means of the locking mechanism (7), the protrusion (9) is squeezed inside the recess (8), providing the storage tank (5) to be tightly fixed to the door (3) (FIG. 4, FIG. 5, FIG. 6).

In an embodiment of the present invention, the protrusion (9) extends from the edge of the cover (6) facing the door (3) towards the recess (8) in the horizontal direction. The protrusion (9) is produced from hard plastic material. While the cover (6) is being fixed to the storage tank (5) by means of the locking mechanism (7), the protrusion (9) bears against the upper wall of the recess (8) and is squeezed between the cover (6) and the recess (8) by stretching a little. Thus, the storage tank (5) is prevented from sliding or moving over the door (3) (FIG. 5, FIG. 6). The storage tank (5) is fixed to the door (3) without using any screws.

In an embodiment of the present invention, the length (L) of the protrusion (9) is almost equal to the depth of the recess (8). The friction force between the protrusion (9) and the upper wall of the recess (8) ensures that the storage tank (5) is kept on the door (3) without moving (FIG. 8).

In an embodiment of the present invention, the length (L) of the protrusion (9) is smaller than the depth of the recess (8). Thus, almost the entire protrusion (9) is provided to remain inside the recess (8) (FIG. 5, FIG. 6). Moreover, it is provided that the rear side of the storage tank (5) is coplanar with the door (3) and the storage tank (5) is not separated from the door (3) (FIG. 8).

In an embodiment of the present invention, the protrusion (9) is produced integrated with the cover (6). Thus, savings in both assembly cost and time are provided (FIG. 7).

In an embodiment of the present invention, the refrigerator (1) comprises the door (3), of which the part at least partially covering the upper surface of the protrusion (9) is in fillet form. Thus, the protrusion (9) can be easily inserted into/removed from the recess (8) (FIG. 8).

The refrigerator (1) realized by means of the present invention comprises a storage tank (5) that is fixed onto the door (3) without using any screws and that is provided to remain on the door (3) in a rigid manner. By means of the protrusion (9), the storage tank (5) and the cover (6) are provided to be fixed to the door (3) without using any screws. The protrusion (9) snap fitted into the recess (8) provides the storage tank (5) and the cover (6) to be firmly mounted to the door (3). Moreover, the protrusion (9) situated on the cover provides savings in assembly time and cost.

It is to be understood that the present invention is not limited to the embodiments disclosed above and a person skilled in the art can easily introduce different embodiments. These different embodiments should also be considered within the scope of the claims of the present invention.

The invention claimed is:

1. A refrigerator (1) comprising
a body (2),
at least one door (3) situated on the body (2),
a water dispenser (4) situated on the door (3) and enabling the user to receive water without opening the door (3),
a storage tank (5) placed over the water dispenser (4) and onto the inner wall of the door (3),
a cover (6) situated on the storage tank (5) and having a closed position wherein the cover (6) is coupled to the top of the storage tank (5) and an open position wherein the cover (6) at least partially opens the top of the storage tank (5),
at least one locking mechanism (7) that enables the cover (6) to be fixed to the storage tank (5) when the cover (6) is in the closed position and
at least one recess (8) arranged on the inner wall of the door (3), behind the storage tank (5), characterized by a protrusion (9)
that is situated on the cover (6),
that is seated into the recess (8) while the cover (6) is being mounted onto the storage tank (5) and that provides the storage tank (5) to be fixed to the door (3) by snap fitting into the recess (8) while the cover (6) is being fixed to the storage tank (5) by means of the locking mechanism (7) wherein the protrusion (9) that extends from the edge of the cover (6) facing the door (3) towards the recess (8) in the horizontal direction.

2. A refrigerator (1) comprising
a body (2),
at least one door (3) situated on the body (2),
a water dispenser (4) situated on the door (3) and enabling the user to receive water without opening the door (3),
a storage tank (5) placed over the water dispenser (4) and onto the inner wall of the door (3),
a cover (6) situated on the storage tank (5) and having a closed position wherein the cover (6) is coupled to the top of the storage tank (5) and an open position wherein the cover (6) at least partially opens the top of the storage tank (5),
at least one locking mechanism (7) that enables the cover (6) to be fixed to the storage tank (5) when the cover (6) is in the closed position and
at least one recess (8) arranged on the inner wall of the door (3), behind the storage tank (5), characterized by a protrusion (9)
that is situated on the cover (6),
that is seated into the recess (8) while the cover (6) is being mounted onto the storage tank (5) and
that provides the storage tank (5) to be fixed to the door (3) by snap fitting into the recess (8) while the cover (6) is being fixed to the storage tank (5) by means of the locking mechanism (7) wherein the protrusion (9) has a longitudinal surface (L) and a width surface, the longitudinal surface mates with a depth surface of the recess.

3. The refrigerator (1) as in claim 2, wherein the protrusion (9), has a length (L) that is smaller than the depth of the recess (8).

4. The refrigerator (1) as in claim 2, wherein the protrusion (9) is produced integrated with the cover (6).

5. The refrigerator (1) as in claim 2, wherein the part of the door at least partially covering the upper surface of the protrusion (9) is in fillet form.

6. The refrigerator (1) as in claim 1, wherein the protrusion (9) has a length (L) for mating to a depth of the recess (8).

7. The refrigerator (1) as in claim 6, wherein the protrusion (9), has a length (L) that is smaller than the depth of the recess (8).

8. The refrigerator (1) as in claim 7, wherein the protrusion (9) is produced integrated with the cover (6).

9. The refrigerator (1) as in claim 8, wherein the part of the door at least partially covering the upper surface of the protrusion (9) is in fillet form.

* * * * *